US005152461A

United States Patent [19]

Proctor

[11] Patent Number: 5,152,461

[45] Date of Patent: Oct. 6, 1992

[54] HAND OPERATED SPRAYER WITH MULTIPLE FLUID CONTAINERS

[76] Inventor: Rudy R. Proctor, 1901 Via Burton, Anaheim, Calif. 92806

[21] Appl. No.: 591,526

[22] Filed: Oct. 1, 1990

[51] Int. Cl.[5] ..... B05B 7/04; B05B 9/043; B05B 11/00

[52] U.S. Cl. ..... 239/304; 239/333; 222/136

[58] Field of Search ..... 239/303, 304, 305, 331, 239/333, 334; 222/136, 145, 340, 383; 215/6, 10; 220/23.4; 206/504

[56] References Cited

U.S. PATENT DOCUMENTS

| | | | |
|---|---|---|---|
| D. 247,302 | 2/1978 | Federico | D23/18 |
| D. 310,632 | 9/1990 | Hutton | D9/412 |
| D. 310,958 | 10/1990 | Biasecker | D9/347 |
| 664,237 | 12/1900 | Deming . | |
| 1,948,401 | 8/1939 | Smith | 91/45 |
| 3,194,426 | 7/1965 | Brown, Jr. | 220/23.4 |
| 3,269,389 | 8/1966 | Meurer et al. | 239/304 X |
| 3,303,970 | 2/1967 | Breslau et al. | 239/304 X |
| 3,338,523 | 8/1967 | Tibbit | 239/61 |
| 3,592,385 | 7/1971 | Smith | 239/10 |
| 3,749,290 | 7/1973 | Micallef | 222/385 |
| 3,770,206 | 11/1973 | Tada | 239/349 |
| 3,786,963 | 1/1974 | Metzler, III | 222/136 |
| 3,843,030 | 10/1974 | Micallef | 222/554 |
| 4,013,228 | 3/1977 | Schneider | 239/401 |
| 4,072,252 | 2/1978 | Steyns et al. | 222/341 |
| 4,082,222 | 4/1978 | Boris | 239/331 |
| 4,153,203 | 5/1979 | Tada | 239/333 |
| 4,165,812 | 8/1979 | Jennison | 215/10 |
| 4,355,739 | 10/1982 | Vierkötter | 222/136 X |
| 4,365,751 | 12/1982 | Saito et al. | 239/333 |
| 4,489,861 | 12/1984 | Saito et al. | 222/207 |
| 4,558,821 | 12/1985 | Tada et al. | 239/333 |
| 4,618,076 | 10/1986 | Silvenis | 222/331 |
| 4,624,413 | 11/1986 | Corsette | 239/333 |
| 4,640,444 | 2/1987 | Bundschuh | 239/333 X |
| 4,646,969 | 3/1987 | Sorm et al. | 222/383 X |
| 4,773,562 | 9/1988 | Gueret | 239/304 X |
| 4,826,048 | 5/1989 | Skorka et al. | 239/304 X |
| 4,826,052 | 5/1989 | Micallef | 222/321 |
| 4,925,066 | 5/1990 | Rosenbaum | 222/383 X |
| 5,009,342 | 4/1991 | Lawrence et al. | 222/136 |

FOREIGN PATENT DOCUMENTS

| | | | |
|---|---|---|---|
| 273798 | 3/1930 | Italy | 239/305 |

*Primary Examiner*—Andres Kashnikow
*Assistant Examiner*—William Grant
*Attorney, Agent, or Firm*—Lyon & Lyon

[57] ABSTRACT

A dispensing device or trigger sprayer which selectively draws fluid out from at least two containers, mixes the fluids in a desired concentration or ratio and expels the mixture of fluids out a nozzle. The trigger sprayer is equipped with a metering device for variably controlling the ratio of the fluids being mixed. The containers or bottles connected to the trigger sprayer are selectively detachable for refilling a container with fluid or exchanging one of the containers with another container having an alternate fluid.

28 Claims, 7 Drawing Sheets

HAND OPERATED SPRAYER WITH MULTIPLE FLUID CONTAINERS

BACKGROUND OF THE INVENTION

The field of the present invention relates to devices for ejecting or spraying a fluid stream or spray through a nozzle from out of a container or bottle.

Heretofore there have been various hand-held sprayers such as that disclosed in U.S. Pat. No. 3,749,290 in which fluid from a container is pumped out by a pump mechanism comprised of a collapsible tubular bulb, the actuation of the trigger compressing the bulb to expel the fluid. Another type of trigger sprayer device is disclosed in U.S. Pat. No. 4,013,228 in which the trigger actuates the piston and cylinder combination which alternately draws fluid in from the container and then expels it out through a nozzle.

The present inventor has discerned that a common element among all the trigger-type sprayer devices is that the sprayers draw fluid from a single container, the sprayer ejecting only that particular fluid and fluid concentration which is within the container.

SUMMARY OF THE INVENTION

The present invention relates to a fluid-dispensing device, in the preferred embodiment a trigger sprayer, which selectively draws fluid out from at least two containers, mixes the fluids in a desired concentration or ratio and expels the mixture of fluids out a nozzle.

In a preferred embodiment the dispensing device is equipped with a means for variably controlling the ratio of the fluids being mixed. In another preferred embodiment, the containers or bottles connected to the sprayer device are selectively detachable for refilling a container with fluid or exchanging one of the containers with another container having an alternate fluid.

In another embodiment the fluid selection control device is included for permitting operative selection of one, two or more containers.

DETAILED DESCRIPTION OF PREFERRED EMBODIMENTS

The preferred embodiments of the present invention will now be described with reference to the drawings. To facilitate description, any identifying numeral representing an element in one figure will represent the same element in any other figure.

Figure 1:
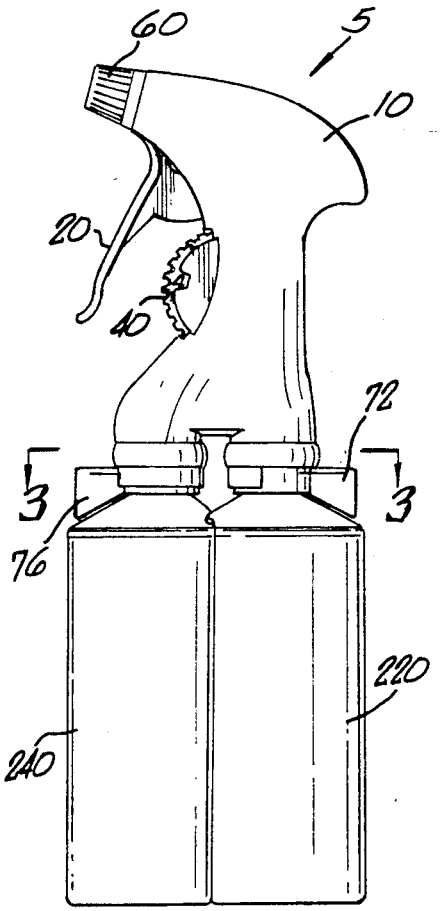
FIG. 1 is a side elevation view of a two-bottle trigger sprayer according to the preferred embodiment of the present invention.
Figure 3:
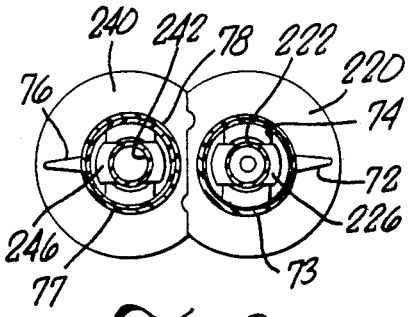
FIG. 3 is a cross sectional view of the spray bottle of FIG. 1 taken along the line 3—3.
Figure 2:
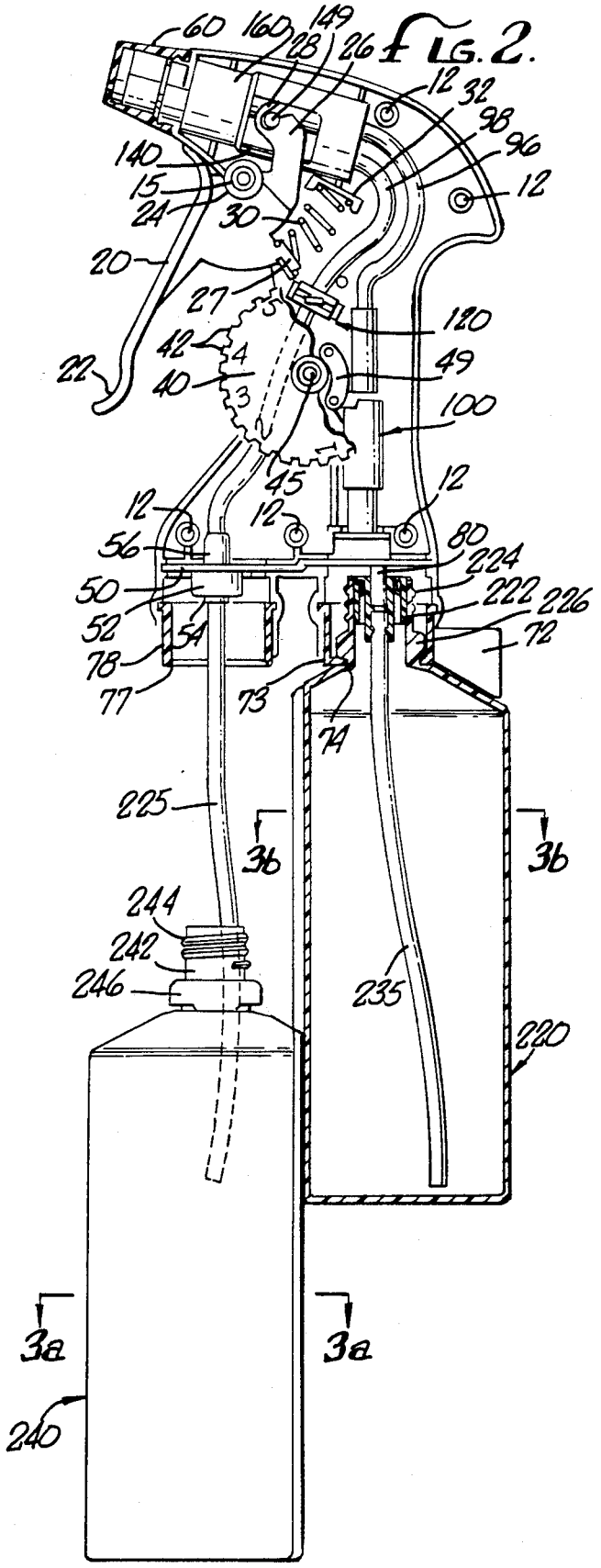
FIG. 2 is the spray and bottle combination of FIG. 1 in a partial cut-away view illustrating the internal mechanisms.
Figures 3A, 3B:
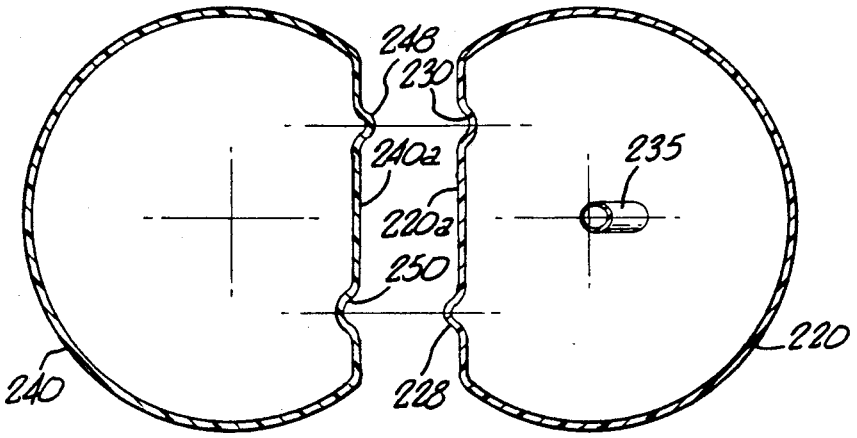
FIG. 3*a* is a cross sectional view of the bottle combination of FIG. 2 taken along the line 3*a*—3*a;*
FIG. 3*b* is a cross sectional view of the spray bottle combination of FIG. 2 taken along the line 3*b*—3*b;*
Figure 4A:
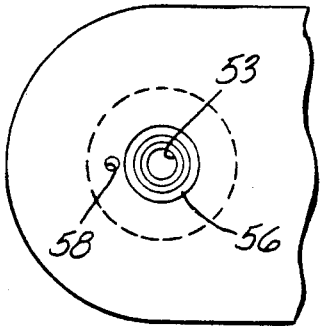
FIG. 4*a* is a cross sectional view of the device of FIG. 4 along the line 4*a*—4*a;*
Figure 5A:
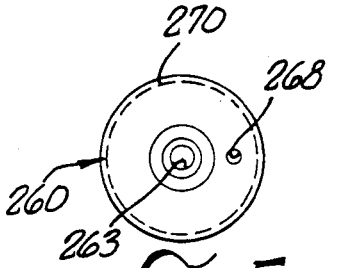
FIG. 5*a* is a cross sectional view of the device of FIG. 5 taken along the line 5*a*—5*a;*
Figure 4:
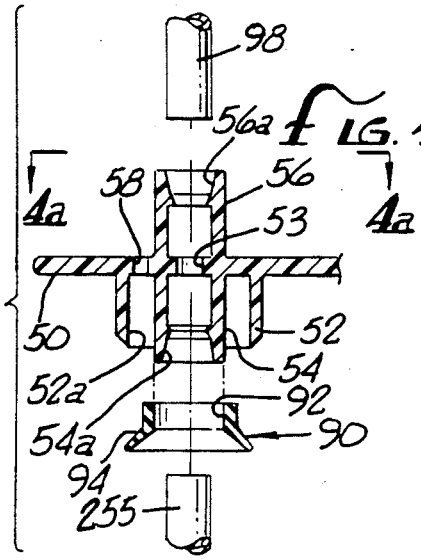
FIG. 4 is an enlarged exploded view of the bottle connection device of FIG. 2.
Figure 5:
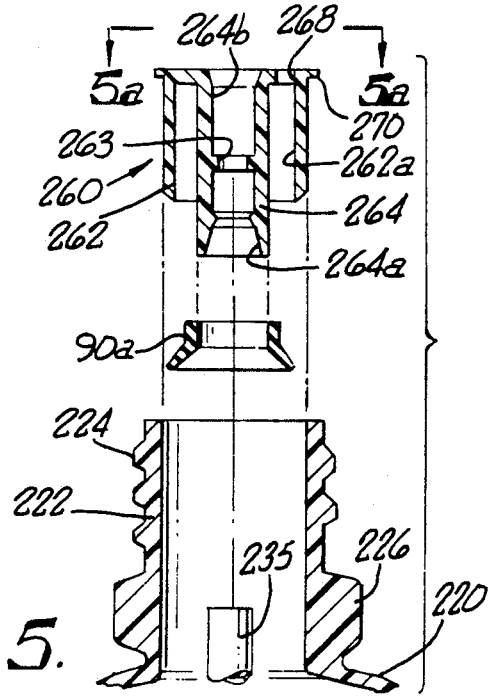
FIG. 5 is an exploded cross sectional view of the bottle neck of FIG. 2.

FIGS. 1-16 illustrate a preferred embodiment for a trigger sprayer 5 according to the present invention. FIGS. 1 and 2 illustrate the trigger sprayer 5 having a sprayer head 10 with a first bottle 220 and a second bottle 240 detachably connected thereto. The first and second bottles 220 and 240 are releasable by operation of respective control tabs 72 and 76. The trigger sprayer 5 includes a trigger 20 which may be manually squeezed by the user to expel fluids out the nozzle cap 60. The user may operably rotate the dial wheel 40 to control relative mixture of fluids from the first and second bottles 220 and 240 by control mechanisms described below. The dial wheel 40 may be continuously variable, have incremental positions such as the six numbered positions (representing selected concentrations 0–5) which may have "click stop" ratcheting mechanism, or some other operable feature.

As shown in FIG. 2, the outer shell of the sprayer head 10 is constructed in two pieces or housing portions which attach to one another by a plurality of posts 12 spaced about the head 10. The sprayer head 10 has a trigger mechanism 20 which includes a cylindrical mounting collar 24 to permit pivoting or rotation about a pivot rod 15 which is comparable to one of the pivot posts 12 spaced about the sprayer head 10. The trigger 20 is comprised of an extending handle portion 22 which accepts the fingers of the operator allowing him to squeeze the device to pivot the trigger 20 about the pivot rod 15 thereby engaging the fluid pumping mechanism.

The fluid pumping mechanism is preferably a piston and cylinder combination comprised of a cylinder housing 160 having a piston 140 slidably actuatable therein. The trigger 20 has a lever arm portion 26 extending with a hooked end portion 28 which engages a trigger post 149 on either side of the piston 140.

A biasing means illustrated as a coiled spring 30 is positioned externally to the piston and cylinder combination. The spring 30 is located between extending portion 27 of the trigger 20 and a seat 32 attached to sprayer head housing 10. The spring 30 biases the trigger 20 in toward an outward position (i.e. in a clockwise position as viewed in FIG. 2) thereby outwardly urging the trigger arm 22 and consequently urging the piston 140 in a direction to expand the volume within the cylinder 160 for drawing fluid into it.

When the piston 140 moves to draw a vacuum within the cylinder 160, fluid is drawn up from both the first bottle 220 and the second bottle 240. Fluid from the first bottle 220 passes through a first suction tube 235, through a metering means 100, through first tubing 96 and to the cylinder 160. Similarly, fluid from the second bottle 240 is drawn through a second suction tube 255, through connectors 54 & 56, into a second tubing 98, past a shut-off gate 120, and to the cylinder 160. Fluid within the cylinder 160 is then, upon squeezing of the trigger 20 and operation of the piston 140, forced out through the nozzle cap 60.

The first and second tubings 96 and 98 are preferably made from a flexible material so that as the piston 140 reciprocates, the tubings 96 and 98 flex back and forth with the piston movement.

The metering means 100 is controlled by rotation of a dial wheel 40, which is rotationally mounted on a pivot post 45. The metering means 100 is a fluid proportioning device which operates by an axial translation which produces variation in flow restriction of fluid therethrough. Rotation of the dial wheel 40 through connector piece 49 causes the axial translation of the top portion of the metering means 100. The metering means 100 is described in detail below.

As viewed in FIGS. 2, 3, 3*a*, and 3*b*, the first and second bottles 220 and 240 have identical shells configurations, the shells being generally round or cylindrical on three sides thereof and having flat portions 220*a* and 240*a* on the fourth sides thereof. The flat sides 220*a* and 240*a* each have a longitudinal groove 230 and 250 and a longitudinal protrusion 228 and 248 extending from the top shoulder to the bottom thereof. As can be viewed in FIGS. 3, 3*a*, and 3*b*, the first bottle 220 and the second bottle 240 are placed with their respective flat portions in an engaging relationship, the protrusion or tongue 228 of the first bottle 220 mates with and nests within the groove 250 of the second bottle 240 and the tongue 248 of the second bottle 240 mates with and nests within the groove 230 of the first bottle 220. This nesting arrangement results in a substantially mating relationship which provides a firmness and stability for the first and second bottles 220 and 240 relative to one another. Additionally, because the first and second bottles 220 and 240 are identical, the bottles are interchangeable and only one bottle design need be tooled and manufactured providing economic advantage.

As viewed in FIGS. 2–5, each bottle 220 and 240 has a bottle collar 226, 246 which may be inserted into a respective rectangular opening 74, 77 within a respective bottle retainer collar 73, 78. The retainer collars 73, 78 are rotatable through a 90° arc by operation of tabs 72, 76. To illustrate the connection operation and referring to FIGS. 2 and 3, once the neck 222 of the first bottle 220 is inserted through the rectangular opening 74 of the retainer collar 73, the tab 72 is then rotated to position the rectangular opening 74 perpendicular to the bottle collar 226, thereby securing the bottle 220 to the sprayer head 10. As viewed in FIG. 3, the bottle collars 226, 246 are also somewhat rectangular (when observed in the plan view of FIG. 3) such that when the bottle collars are aligned, as for example in FIG. 2, the bottle collar 246 of the second bottle 240 may be slid through the bottle retainer collar 78 which has been rotated 90° such that the rectangular opening 77 aligns with the bottle collar 246, and the bottle collar 246 may be inserted through the rectangular opening 77. Once in place, the tab 76 may be actuated, rotating the bottle retainer collar 78 by 90°, as in FIG. 3, which secures the second bottle 240 in place.

In order to operationally describe the connecting apparatus, an example of a preferred application will now be described. The first bottle 220 may be filled with a fluid, such as a concentrated household cleaning fluid, and the second bottle 240 is then filled with a diluting fluid, typically water. The sprayer device then meters out a mixture of the cleaning fluid diluted with water, the household user refilling the second bottle 240 with water as needed.

The fluid connection for the second bottle 240 is illustrated in FIGS. 2–4 and 4*a*. The second suction tube 255 is inserted into a lower nipple 54 in the bottom of a tube retainer piece 50, the tube retainer piece 50 fitting in the bottom of the sprayer head 10. Fluid may pass through the second suction tube 255 through the lower nipple 54, through a passage 53 within the tube retainer piece 50, and then out through an upper nipple 56 into which the second tubing 98 is inserted. The tube retainer piece 50 has a collar section 52 concentric with the lower nipple 54 forming an annular passage 52*a* therebetween. The bottle neck 242 may be inserted over and around the concentric collar 52, the collar 52 may have a slight inward taper to allow for a tight sealing fit against the inside surface of the bottle neck 242.

Operationally in a preferred embodiment, the second bottle 240, after being filled with water, may be inserted around the second suction tube 255 into the bottle retainer collar 78, with the bottle neck 242 being firmly pressed around the concentric collar 52. Since the connection between the bottle neck 242 and the concentric collar 52 is airtight or at least substantially leak-proof, air is generally unable to enter the second bottle 240 to replace the volume of fluid which is pumped out through the second suction tube 255. To prevent creation of such vacuum, a venting means is provided to allow for air passage into the second bottle 240.

The preferred venting means includes an air passage through a vent hole 58 in the tube retainer piece 50. To prevent liquid from undesirably leaking out through the vent hole 58, the venting means comprises a retainer seal 90 positioned within the annulus 52*a* between the concentric collar 52 and the lower nipple 54. The retainer seal 90 is of generally a tubular shape with a first cylindrical portion which fits tightly against the outer surface of the lower nipple 54 and a diagonally outwardly extending or fanning portion 94 extending outward from the cylindrical portion 92 toward the inner surface of the concentric collar 52. The outwardly extending portion 94 fills and seals off the annular space 52*a*, pressing against the inner surface of the concentric collar 52. Due to its angular orientation, the retainer seal 90 acts as a one-way valve permitting air passing through vent hole 58 to inwardly flex the outwardly extending portion 94 of the retainer seal 90 and to enter the bottle 240 while preventing fluid from the bottle 240 to pass by the retainer seal 90 and leak out the vent hole 58.

The first bottle 220 has a similar venting means configuration comprised of a plug 260 having an inner nipple 264 and an outer concentric portion 262, the plug being inserted into the neck 222 of the first bottle 220 in a liquid-tight arrangement. The first suction tube 235 is inserted into the inner nipple 264. The upper portion 264*b* of the plug nipple 264 is inserted around the nipple 80 of the tube retainer piece 50. The nipple 80 is tapered to allow for a tight sealing fit against the inside surface of the plug nipple 264. An annular passage is provided between the plug nipple 264 and the concentric portion 262 which provides a venting passage for allowing air to enter the bottle 220 to replace fluid being pumped out through the first suction tube 235. A venting means comprised of a retainer seal 90*a* is provided filling the annular passage 262*a* so that air passing through vent hole 268 may pass the retainer seal 90*a* and enter the bottle 220, but fluid is prevented from passing the retainer seal 90*a* and reaching the vent hole 268. The plug 260 has an upper lip or shoulder 270 so that when it is inserted into the bottle neck 222, it is prevented from being pushed down past the upper rim of the bottle neck 222.

The bottle neck 222 includes male threads 224 even though the threads are not used in the operation of the spray bottle. And as previously described, the first bottle 220 may be filled with a concentrated liquid which will be diluted by the device. A bottle of concentrate may be packaged individually with a screw cap secured over the bottle neck 222. The user need only remove the cap (not shown) and install the bottle 220 as previously described, since the plug 260, the retainer seal 90*a* and the first suction tube 235 may already be assembled within the first bottle 220. In addition, it may be desireable to switch to another bottle of concentrate, and the removed bottle may be conveniently recapped for storage.

Figure 6:
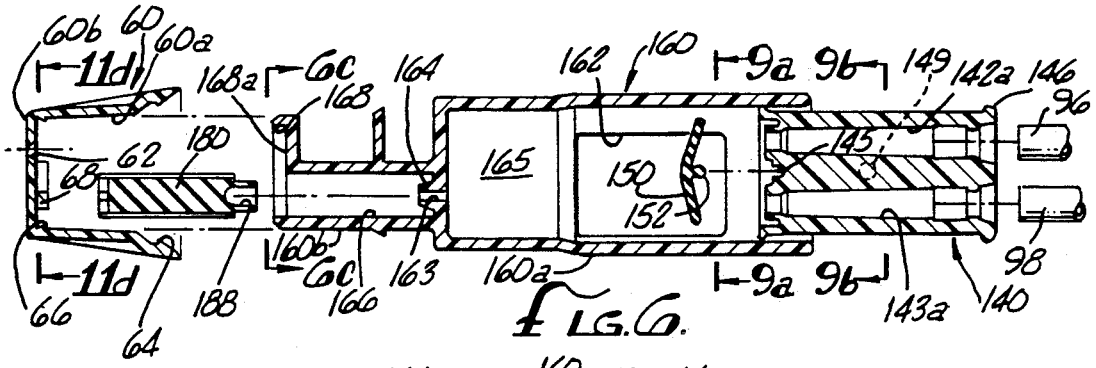
FIG. 6 is an exploded cross sectional view of the pumping device of sprayer combination of FIG. 2.

There are several types of pumping means which have been employed in fluid dispensing devices. The preferred piston and cylinder combination and nozzle disclosed herein is illustrated in FIGS. 6–11. FIG. 6 illustrates a partially exploded view of the pumping elements comprised primarily of a cylinder housing 160, a piston 140, a nozzle cap 60, and a tip seal 180. The cylinder housing 160 has a rear portion 160*a* having a rectangular window 162 on either side. The rectangular window 162 allows for access of the trigger arm 26 to reach the trigger post 149 on the piston 140.

In the front portion of the cylinder housing 160*a* is the fluid compression chamber 165 where fluid from the first and second bottles 220 and 240 is mixed for ejection to the nozzle 60. A port 163 is located in the downstream end of the cylinder chamber 165 providing fluid communication from the cylinder chamber 165 to the nozzle passage 166. The port 163 has a protrusion or nipple portion 164 extending into the nozzle passage 166.

On the downstream end of the nozzle passage 166 is a shoulder or lip 168 which is positioned to provide a spacing between the front face 60*b* of the nozzle cap 60 and the front face portion 68*a* at the end of nozzle passage 166. The nozzle cap 60 has a snap connection 64 which, when the two halves of the sprayer head 10 are assembled, snaps over both halves as viewed in FIG. 2. The nozzle cap 60 has a sealing surface 62 which presses against the lip portion 168 in a sealing arrangement. The tip seal 180 is an elongated flexible rubber piece positioned within a nozzle passage 166 described in more detail below.

The piston 140 has a first passage 142*a* in fluid communication with the first tubing 96 and a second passage 143*a* in fluid communication with the second tubing 98. When positioned in the cylinder portion 160, the piston 140 has a front sealing rim 144 sealingly engaging the inner surface of the fluid chamber 165 and a rear rim 146 engaging the inner surface of the rear portion 160*a* of the cylindrical portion 160. The rear portion 160*a* of the cylindrical portion 160 may be provided with grooves to correspond to protrusions in the lip portion 146 to ensure that the piston remains in rotational alignment within the cylinder 160.

The piston 140 has a disk-shaped diaphragm 150 installed on its downstream end providing a one-way valve relationship from the passage exits 142*b* and 143*b*. The diaphragm 150 operates as a flapper or butterfly type one-way valve. It has a protrusion portion 152 which snap fits into a groove 145 in the piston 140. As shown in FIG. 6, in its resting state, the diaphragm 150 has a camber of approximately 15° so that when installed upon the piston, the outward wing portions are biased against the exit portions 142*b* and 143*b* of the piston 14 establishing a positive sealing pressure against the valve seats 142*b* and 143*b*. When the unit is at rest, this positive sealing pressure inhibits fluid leaking from the chamber 165 back into the bottles 220 and 240. This positive sealing pressure also inhibits siphoning of fluids between the bottles 220 and 240 through the chamber 165.

The operations of the retainer seals 90 and 90*a* also serve to inhibit siphoning of fluids between the bottles 220 and 240. For example, the retainer seal 90 is placed in the annular space 52*a* in a flexing condition, exerting positive pressure against the side walls to seal of the passage. In order for a siphoning effect (out of bottle 240) to occur, the siphoning force would have to overcome the sealing force of the flexed retainer, so the siphoning effect is inhibited. Similarly, for fluid to be siphoned into the second bottle 240 air would have to be released to make room for any incoming fluid. The retainer seal 90 prevents fluid or air from escaping past the retainer seal 90 thereby inhibiting fluid from even entering the bottle 240.

Figure 6A:
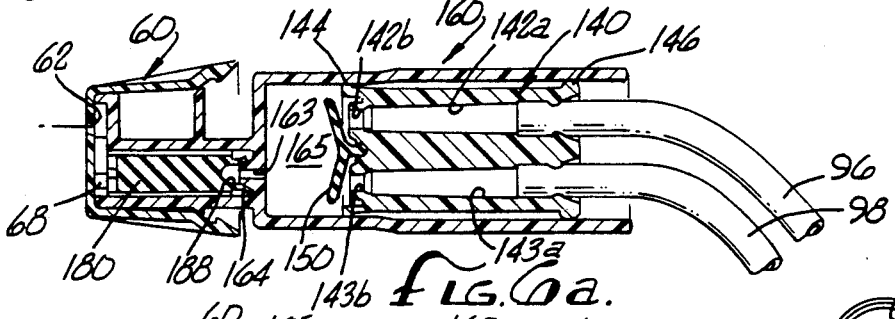
FIGS. 6*a* and 6*b* illustrate the operation of the piston and cylinder and nozzle combination of FIG. 6, FIG. 6*a* illustrating the piston drawing liquid into the cylinder chamber and FIG. 6*b* illustrating the piston expelling liquid out of the cylinder chamber.
Figure 6B:
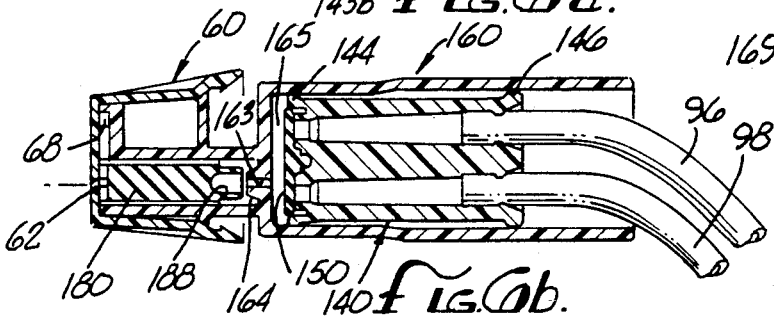

In operation, when the piston 140 is actuated to the right as viewed in FIG. 6*a* (by operation of the spring 30 as viewed in FIG. 2), fluid is drawn through the passages 142*a* and 143*a*, the diaphragm 150 flexing (as shown in the FIG. 6*a*) to permit fluid to enter the fluid chamber 165. When the trigger 20 is squeezed, the piston 140 is moved to the left as viewed in FIG. 6*b* and the fluid within the chamber 165 is compressed, the diaphragm 150 pressing against and sealing off the cylinder ports 142*b* and 143*b* forcing fluid out through the port 163 into the nozzle passage 166.

Since the biasing means is external to the cylinder chamber 165, the piston 140 may be pressed all the way to the wall of the cylinder 160 which substantially allows the fluid chamber 165 to be completely emptied.

The divided passage piston 140 permits the fluids from the first and second bottles 220 and 240 remain separated and at their original concentrations all the way to mixing chamber 165.

The tip seal 180 is a highly flexible and preferably elastic elongated member having a plurality of longitudinal ribs 182 spaced around its outer perimeter. At its downstream edge, the tip seal 180 has an outwardly lip or edge 84 forming a front facing recess 184. The lip 84 has a pair of parallel angular gaps 186 which creates a swirling motion when fluid enters into the recess 184.

The tip seal 180 is preferably of one-piece construction. In operation, fluid is allowed to pass in an annular space between the outer circumference of the tip seal 180 along the ribs 182 and the inner wall of the nozzle passage 166. The tip seal 180 may be sized to substantially fill the nozzle passage 166 so that at the end of the compression stroke of the piston 140, nearly all the fluid mixture may be dispensed out the nozzle opening 62.

The tip seal 180 also includes a recess or cavity 188 which corresponds to the protrusion 164 of the port 163. The tip seal 180 is axially translatable within the nozzle passage 166 between positions illustrated in FIGS. 6*a* and 6*b*. During the rearward stroke of the piston 140 filling the fluid chamber 165, the tip seal 180 is drawn rearward as viewed in FIG. 6*a* with the recess 188 engaging the protrusion 164 effectively sealing off the port 163. During the compression stroke as in FIG. 6*b*, fluid exiting the ports 163 presses the tip seal 180 downstream to permit exit of fluid through the port 163 and into the nozzle chamber 166. The tip seal 180 functions as the second one-way valve of the positive displacement from piston and cylinder combination.

In a preferred embodiment the tip seal 180 is constructed from a relatively soft and resilient material which is stretched over the protrusion 164 (the protrusion 164 extending further into the cavity 188 than shown in the figures). In operation, the force of fluid exiting the port 163 causes the tip seal cavity 188 to expand and allow the fluid to enter the passage 166. When the fluid flow stops, the tip seal 180 resiliently returns against the protrusion 164 exerting a positive sealing force thereagainst. The flexure of the tip seal 180 itself would inhibit leakage of fluid out the nozzle even when the sprayer is in a resting state.

This functional combination of (1) the cylinder 140 completely emptying the fluid chamber 165, (2) minimizing the volume of left-over fluid downstream of the fluid chamber, and (3) keeping the fluids from the first and second bottles 220 and 240 remain separated and at their original concentrations all the way to mixing chamber 165 all contribute to insuring that a minimum amount of mixed fluid (that is, fluid from a particular actuation) remains in the system for a subsequent actuation. Therefore, when a different fluid mixture setting is selected, a minimum amount of fluid mixture from the previous setting, i.e. substantially only one volume of the fluid chamber 165, is ejected which has the previous setting for concentration mixture.

The nozzle cap 60 includes an exit opening 62 which is tapered having a decreasing diameter. The nozzle opening 62 is eccentrically positioned on the front face of the nozzle cap 60, the nozzle cap 60 being rotatable between positions to select a spray pattern. The nozzle may be positioned to select a wide spray, a fine stream, or a shut-off position.

Figure 6C:
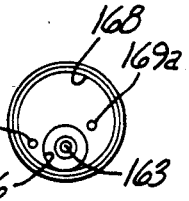
FIG. 6*c* is a side elevation view of the cylinder of FIG. 6 taken along the line 6*c*—6*c;*
Figure 8:
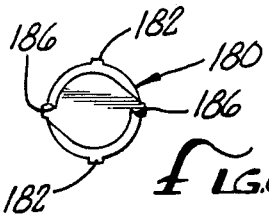
FIG. 8 is a front elevation view of FIG. 7 taken along the line 8—8.
Figure 7:
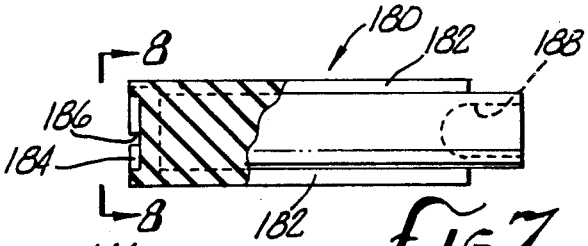
FIG. 7 is a side elevation view in partial cross section of the tip seal of FIG. 6.
Figure 9B:
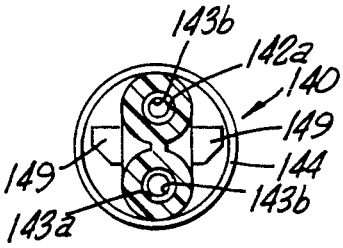
FIG. 9*b* is a cross sectional view of the device of FIG. 6 taken along the line 9*b*—9*b;*
Figure 10:
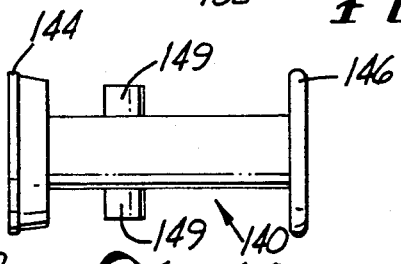
FIG. 10 is a top plan view of the cylinder of FIG. 6.
Figure 9A:
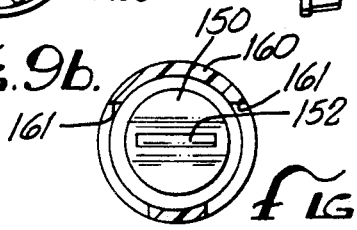
FIG. 9*a* is a cross sectional view of the device of FIG. 6 taken along the line 9*a*—9*a;*
Figure 11A:
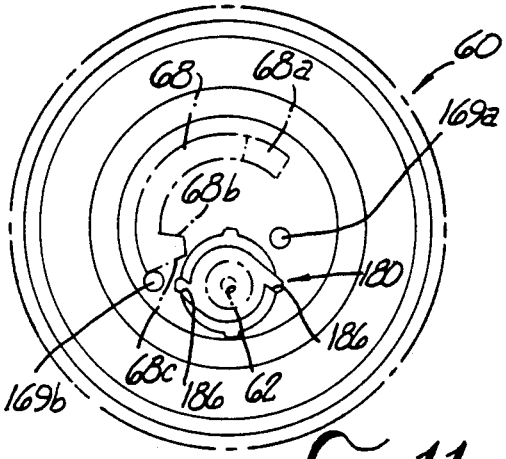
FIGS. 11*a*, 11*b* and 11*c* diagrammatically illustrate the operation of the exit nozzle of FIG. 6, FIG. 11*a* illustrating the nozzle in a wide spray mode, FIG. 11*b* illustrating the nozzle in a fine stream spray mode, and FIG. 11*c* illustrating the nozzle in a shut-off mode.

As viewed in FIG. 6*c*, the face 168 of the cylinder portion 160 has a pair of stops 169*a* and 169*b* which function to assist in the positioning of the rotation nozzle cap 60. In FIG. 11*a* the nozzle cap 60 is rotated in a counter-clockwise direction with the rotation halted when the stop surface 68*c* engages the stop 169*b* thereby positioning the nozzle aperture 62 in line with the tip seal 180. Fluid swirling through the apertures 186, 186 exits the nozzle aperture 62 in a wide spray pattern.

Figure 11B:
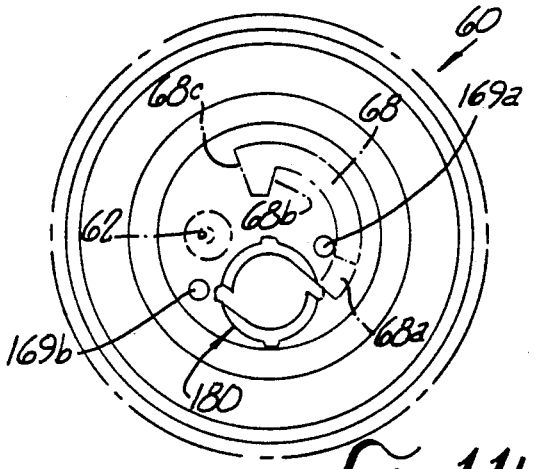

In FIG. 11*b*, the nozzle cap 60 is rotated to a position with the stop surface 68*c*/68*b* between the stops 169*a* and 169*b*. In this position, the nozzle aperture 62 is offset from the tip seal 180 and fluid exiting the nozzle passage 166 is not swirled and therefore exits the nozzle aperture 62 in a fine stream spray pattern.

Figure 11C:
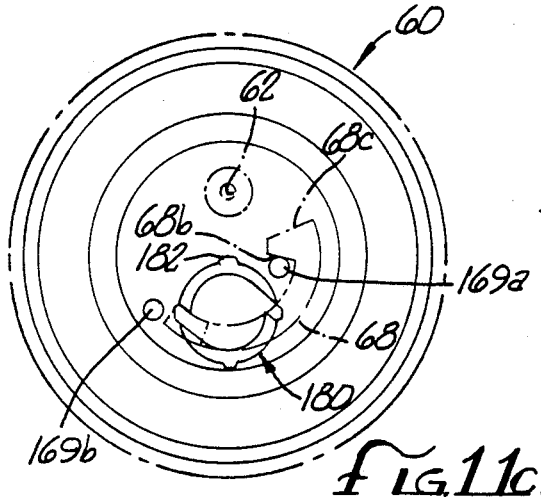
Figure 11D:
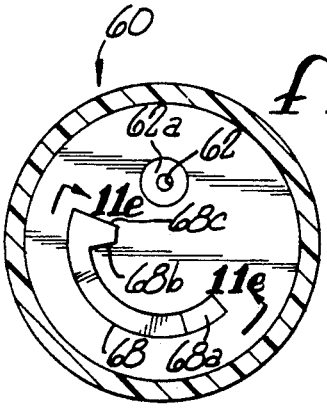
FIG. 11*d* is a cross sectional view of the nozzle cap of FIG. 6 taken along the line 11*d*—11*d;*
Figure 11E:
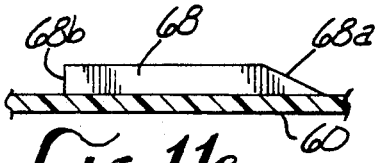
FIG. 11*e* is a cross sectional view of the nozzle tip of FIG. 11*d* taken along the line 11*e*—11*e;*

In FIG. 11*c*, the nozzle cap 60 has been rotated in a clockwise direction with the rotation halted when the stopping surface 68*b* engages against the stop 169*a*. In this position, the location of the nozzle aperture 62 is irrelevant. Referring also to FIGS. 11*d* and 11*e*, the curved stop surface 68 has a ramp 68*a* which engages the tip seal 180 when the nozzle cap 60 is rotated into position as illustrated in FIG. 11*c*. When placed in such position, as viewed in FIG. 6*a*, the curved stop surface 68 presses against the tip seal 180 forcing it against the port protrusion 164 with the tip seal recess 188 sealing off the port 163 effectively shutting off the exit of fluid therethrough.

The flow control device will now be described with respect to FIGS. 12–16. The heart of the flow control device which allows for varying the ratio of fluid mixture between the first bottle to 20 and the second bottle to 40 is the metering means 100. The metering means has an outer cylindrical housing piece 102 and an inner metering rod 110. Fluid from the first bottle 220 passing through the nipple 80 enters into a chamber 112 within the metering rod 110. The base 116 of the metering rod 110 seats within a cylindrical protrusion 82 in the tube retainer piece 50, the base 116 having a lower cylindrical leg portion 114 seating concentrically within the cylindrical portion 82 to provide firm support and additional sealing surface therebetween. Once fluid has passed into the inner chamber 112 of the metering rod 110, it may pass outward through ports 114 and into an annular space between the top portion 110*b* of the metering rod 110 and the lower portion 102*a* of the meter housing 102.

Figure 12A:
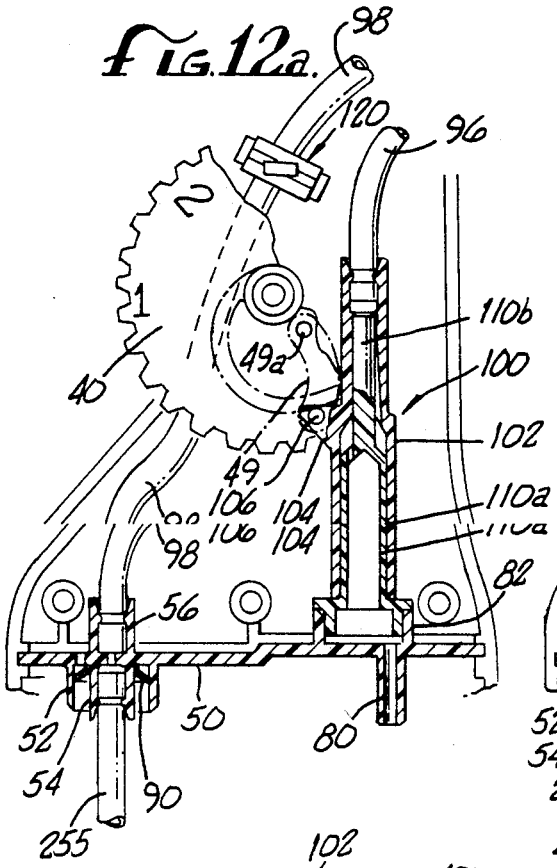
FIGS. 12*a* and 12*a* illustrate the operation of the metering device of the sprayer, FIG. 12*a* illustrating the metering device closing off the flow of fluid therethrough, FIG. 12*b* illustrating the metering device at maximum flow therethrough.
Figure 12B:
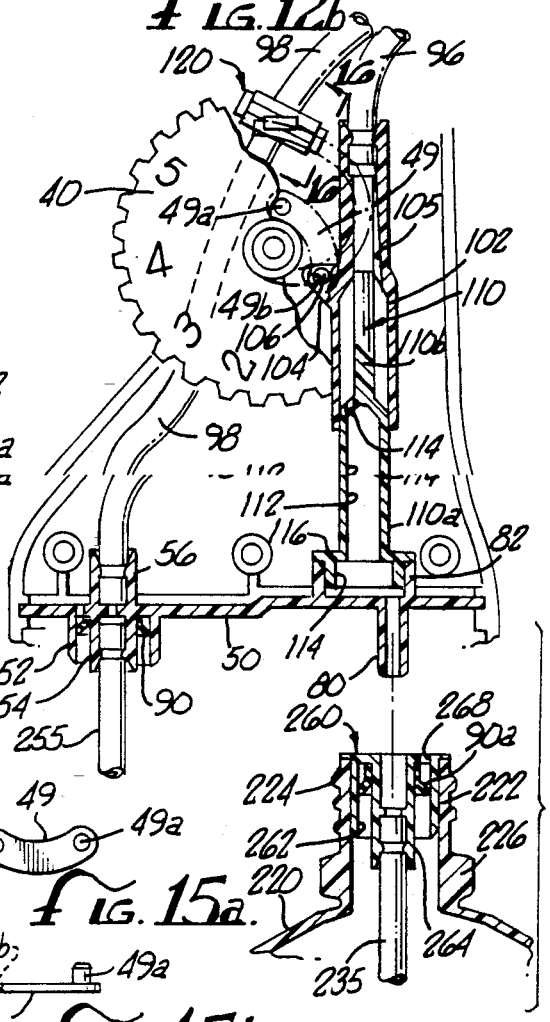
Figure 14:
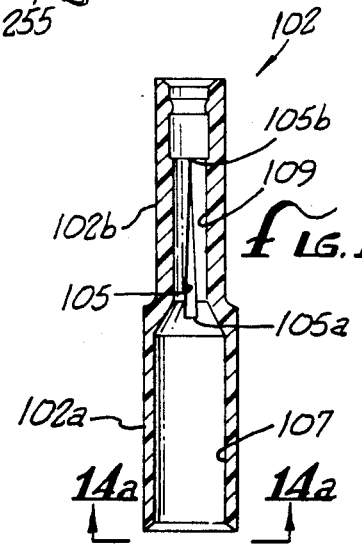
FIG. 14 is an enlarged view of the movable portion of the metering device of FIGS. 12*a* and 12*b;*
Figure 15A:
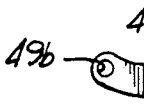
FIG. 15*a* is a plan view of the connector piece connecting the metering control wheel to the metering device of FIG. 12*a;*
Figure 15B:
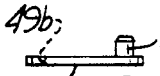
FIG. 15*b* is a side elevation view of the connector piece of FIG. 15*a;*
Figure 16:
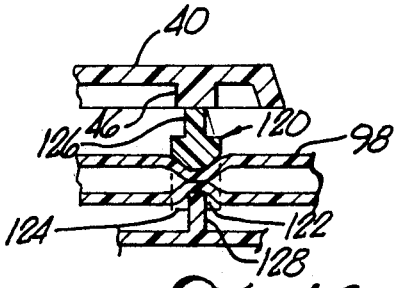
FIG. 16 is a cross sectional view of the cut-off gate of FIG. 12*b* taken along the line 16—16.
Figure 14A:
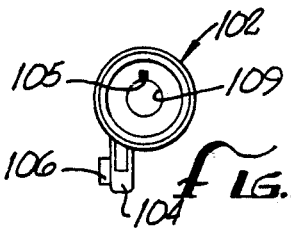
FIG. 14*a* is a bottom plan view of the metering device portion of FIG. 14 taken along the line 15—15.

By rotation of the dial wheel 40, the meter housing 102 may be axially translated from an off position or low flow position as viewed in FIG. 12*a* to a high flow position as viewed in FIG. 12*a*.

Fluid flows between the upper portion 110*b* of the metering rod 110 and the upper passage 109 of the meter housing 201 through an axial slot 105 cut along the inner surface of the upper portion 102*b* of the meter housing 102. Except within this passage 105, the upper portion 110*b* of the metering rod 110 snugly fits within the upper passage 109 of the meter housing 102 thereby finally regulating the flow of fluid through the passage 105.

The depth and width of the passage 105 are gradually reduced from the upstream portion 105*a* to the downstream portion 105*b*. If desired, the metering rod 110 may have a position as in FIG. 12*a* which completely shuts off flow of fluid through the passage 105.

In order to prevent leakage of fluid, a sealing mechanism is provided between the metering rod 110 and the meter housing 102 comprised of a radial rim along an outer circumference adjacent the ports 114, the rim being approximately 0.005 inches high by 0.020 inches wide. In addition metering rod 110 and the meter housing 102 may be constructed from different density materials. In the preferred application, the metering rod 110 is constructed from high density polyethylene and the meter housing is constructed from low density polyethylene. This design and material selection enhance the sliding seal between the metering rod 110 and the meter housing 102.

As viewed in FIGS. 12*a*, 12*b*, 14*a*, 15*a*, and 15*b*, the meter housing 102 includes an extending arm 104 having a protrusion which mates into a hole 49*b* in the connector piece 49. A protrusion 49*a* on the other end of the connector piece 49 is inserted into a matching hole 45 in the dial wheel 40. The connector 99 is connected to the dial wheel 49 in an off-centered relationship to the center of the dial wheel 40 such that when the dial wheel 40 is rotated, the meter housing is axially translated as previously described.

Figure 13A:
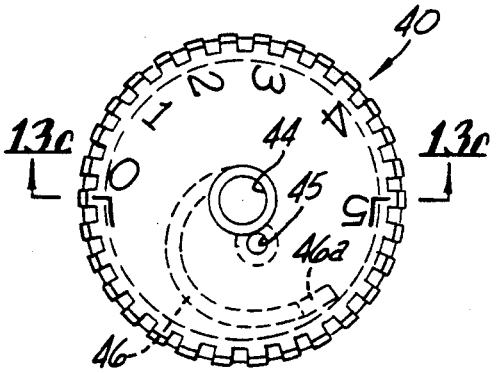
FIG. 13*a* is a top plan view of the metering dial of FIGS. 12*a* and 12*b;*
Figure 13B:
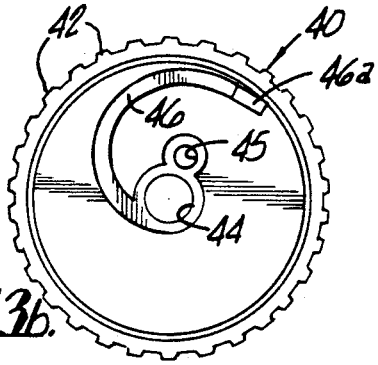
FIG. 13*b* is a rear plan view of the metering dial of FIG. 13*a;*
Figure 13C:
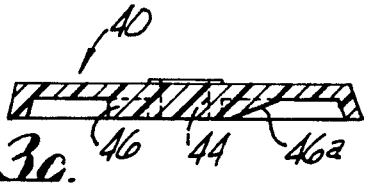
FIG. 13*c* is a cross sectional view of the control dial of FIG. 13*a* taken along the line 13*c*—13*c;*

Details of the dial wheel 40 are illustrated in FIGS. 13*a*, 13*b*, and 13*c*. Dial wheel 40 has a notch connection 44 secured into a post within the spray head 10 as previously described. A curved ramp 46 with an end ramping portion 46*a* is positioned along an inner face thereof. As viewed in FIG. 12*b*, when the meter housing is translated into the maximum flow condition, the ramp 46*a* engages the flow cut-off device 120 as viewed in FIG. 16. The flow cut-off device is a gate device which straddles the second tubing 98 when the ramp 46 engages the upper portion 126 of the cut-off mechanism 120, the sliding gate squeezes the second tubing 98 against a lower edge portion 128 restricting and then cutting off flow of fluid within the second tubing 98. Therefore, at maximum flow out of the first bottle 220, flow from the second bottle is cut-off so that the fluid dispensed is 100% from the first bottle 220.

There are many variations to the above-described preferred embodiments. It has been described that a flow metering or flow ratio varying device may be manually adjusted to select relative flow ratios anywhere between 100% fluid from the first bottle 220 to 100% from the second bottle 240. Of course, an alternate spray head may have ratio limits of any minimum or maximum amount. Alternately, a spray head may be provided without varying control but merely have a preset ratio position which, for example, would spray out a preset concentration of a diluted fluid.

The connection designs for the first and second bottles 220 and 240 as disclosed above were selected for a particular application, but both of the connection designs may be used at either bottle location. For example, a sprayer may be comprised of both bottles having removable and refillable bottle connections as possessed by the second bottle 240.

The materials of construction will be in part dependant upon the types of fluid being used in the bottles. For example, in the application where the first bottle 220 is filled with high concentration cleaning fluid and the second bottle is filled with water as a diluting fluid, certain materials may be preferred. The tubings, particularly the ones that come in contact with the concentrated cleaning fluid, may be constructed from ethyl-based urethane. The bottles 220 and 240 and the other components in fluid contact with the cleaning fluid may be made from ethyl based polyethylene. The seals, namely the tip seal 180, the diaphragm seal 150, and the retainer seals 90 and 90*a* may be constructed from compression molded silicon.

Figures 17, 18:
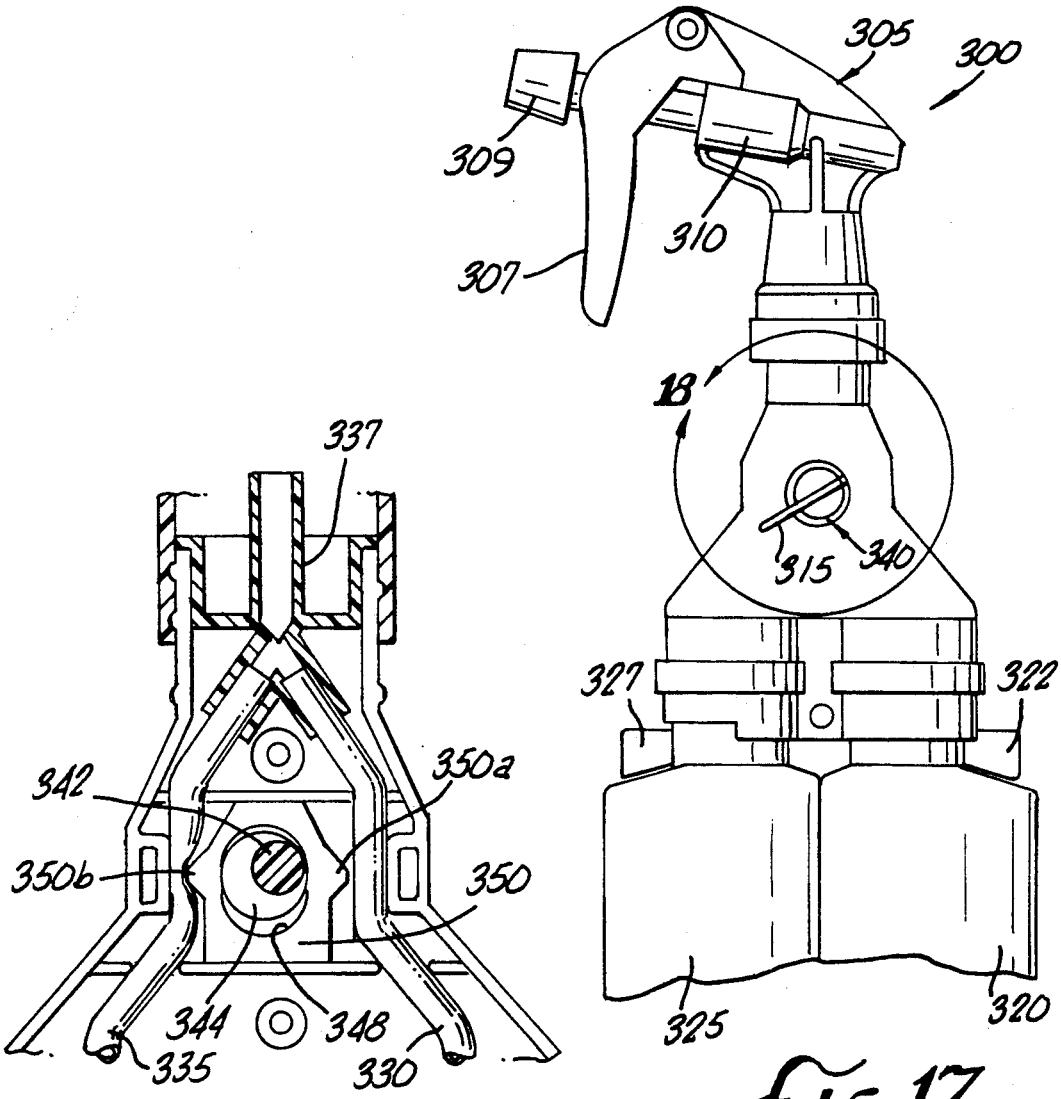
FIG. 17 is an alternate embodiment trigger sprayer device.
FIG. 18 is a diagrammatic view of the control device of FIG. 17.

An alternate spray bottle 300 is illustrated in FIGS. 17 and 18. This sprayer 300 has a sprayer head 305 which is installed on first and second bottles 320 and 325 detachably connected by tabbing mechanisms 322 and 327 similar to those as previously described. The sprayer head 305 has a pumping mechanism 310, a trigger 307 and an exit nozzle 309.

Flow ratio control is accomplished by a rotating switch 340 having an actuator handle 315. The switch 340 may have incremental positions or be continuously variable. The handle 315 rotates about an inner shaft 342 to which a cam 344 is attached. The cam 344 rotates within a slot 348 in a sliding gate 350. The gate 350 has protrusions 350*a* and 350*b* on opposite ends thereof which, depending upon the position of the switch 315 (and thereby the position of the cam 344) slides to one side or the other depressing the first tubing 330 or the second tubing 335 selectively restricting flow through one or the other thereby controlling the fluid ratio. In this embodiment, the tubings 330 and 335 are connected through a "Y" connector 337 before entering the pump mechanism 310, but the pump mechanism could be identical to the dual passage piston combination previously described.

Figure 21:
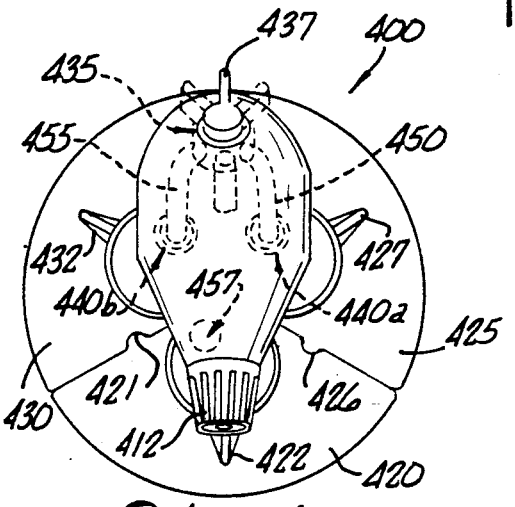
FIG. 21 is a top plan view of FIG. 20 taken along the line 21—21.
Figure 20:
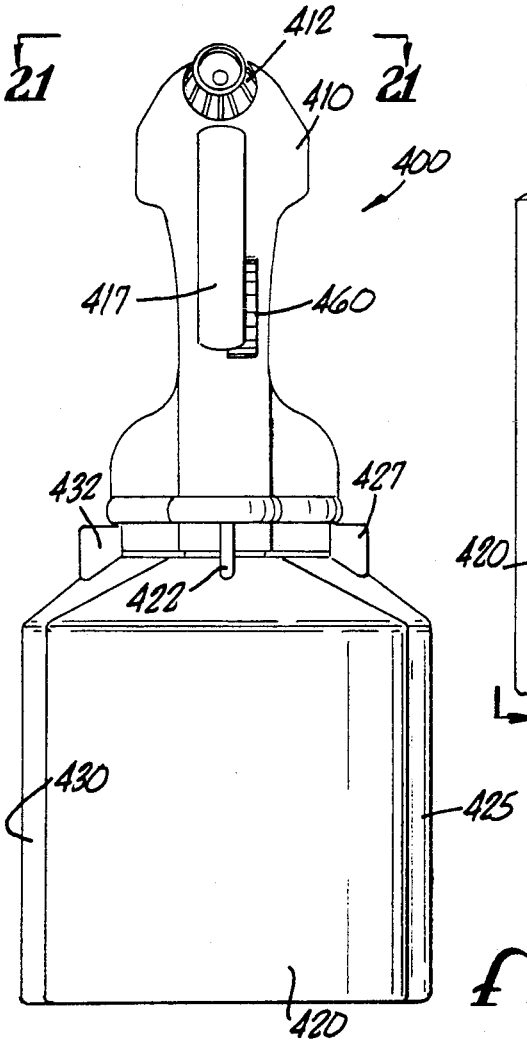
FIG. 20 is a front elevation view of the trigger spray device of FIG. 19 taken along the line 20—20.
Figure 19:
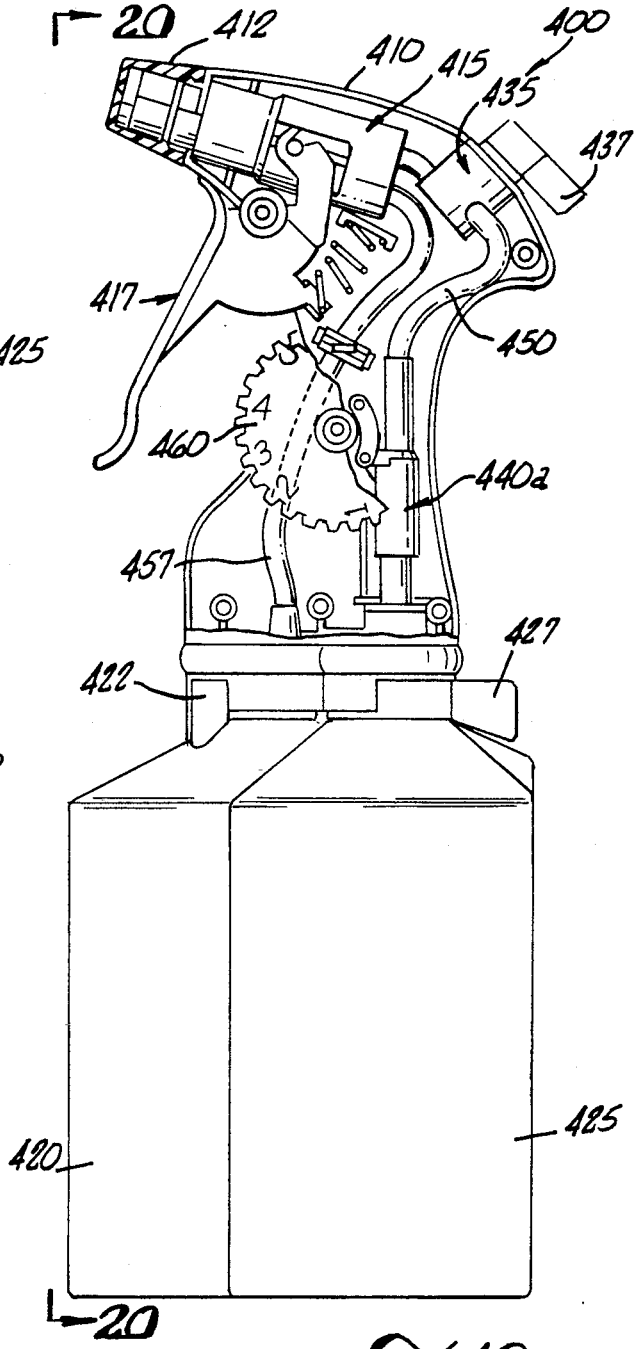
FIG. 19 is a side elevation view in partial cross section of an alternate trigger sprayer device having three fluid containers form which fluids can be drawn.

The preferred embodiment of the present invention is not limited to a two-bottle configuration, and FIGS. 19–21 illustrate a three-bottle combination. The three-bottle design sprayer 400 has a sprayer head 410 mounted upon three bottles, 420, 425 and 430. The bottles 420, 425, and 430 are generally pie-shaped with tongue and groove connections such as 421 and 426 of similar configuration to the two-bottle design previously described. Desirably, each of the bottles is interchangeable as in previous embodiments. The bottles are detachably secured to the head 410 by rotation of tabs 422, 427 and 432 using mechanisms also previously described.

One use for this tri-bottle configuration would be having a first fluid concentrate in the first bottle 425, and a second fluid concentrate in the third bottle 430. The second bottle 420 would then contain the dilution fluid such as water. Both the first bottle 425 and the third bottle 430, have respective metering devices 440*a* and 440*b* and respective tubings 450 and 455 leading up to a valving mechanism 435.

By manipulation of the dial wheel 460 (of course, there could be a dial for each metering device) both the metering devices 440*a* and 440*b* are actuated to provide the desired concentration ratio. The upper control device 435 has a handle switch 437 which may be actuated between any desired position, FIG. 21 arbitrarily illustrating three positions namely a first position having fluid completely from the first bottle 425, a second middle position allowing fluid from both the first bottle 425 and the third bottle 430, and a third position permitting fluids solely from the third bottle.

The metering switch 435 may be comprised of the cam construction as that previously described in the previous embodiment in FIG. 18. Similarly, the pumping device 415 may include three passages therethrough so that the fluid mixing takes place in the cylinder chamber as far downstream as possible. Alternately, the exit port from the metering device 435 may include a "Y" connection so that the pumping device has a two-passage piston as previously described in the embodiment of FIG. 1.

Thus, a multiple fluid dispensing apparatus has been shown and described. Though certain examples and advantages have been disclosed, further advantages and modifications may become obvious to one skilled in the art from the disclosures herein. The invention therefore is not to be limited except in the spirit of the claims that follow.

I claim:

1. A spray bottle combination comprising:

a sprayer mechanism including (a) a sprayer housing, (b) a discharge nozzle, (c) a cylinder chamber, (d) piston means disposed in the cylinder chamber axially moveable in a first direction for discharging fluid out the cylinder chamber to the discharge nozzle and in a second direction for drawing fluid into the cylinder chamber, and (e) actuation means for actuating the piston means, wherein actuation of the piston means forces fluid from the cylinder chamber out the discharge nozzle;

a first bottle containing a first fluid connectable to the sprayer housing;

a second bottle containing a second fluid connectable to the sprayer housing;

a first tubing means for providing fluid communication for the first fluid between the first bottle and the cylinder chamber;

a second tubing means separate and independent from the first tubing means for providing fluid communication for the second fluid between the second bottle and the cylinder chamber; and means for controlling relative amounts of first and second fluids entering the cylinder.

2. A spray bottle combination according to claim 1 further comprising a spring means for biasing the piston means in the second direction for drawing fluid into the cylinder chamber.

3. A spray bottle combination according to claim 2 wherein the spring means is positioned external to the cylinder chamber.

4. A spray bottle combination according to claim 3 wherein the actuation means comprises a trigger pivotally supported on the sprayer housing, the trigger including a lever arm portion which pivotally engages a post attached to the piston means for actuating the piston means and wherein the spring means is positioned on the trigger.

5. A spray bottle combination according to claim 1 wherein said first bottle and said second bottle are constructed and arranged in a mating relationship to one another.

6. A spray bottle combination according to claim 5 wherein said first bottle and said second bottle each include collar means for permitting independent detachable connection to the sprayer housing.

7. A spray bottle combination according to claim 5 wherein said first bottle and said second bottle are essentially interchangeable with one another.

8. A spray bottle combination according to claim 5 wherein said first bottle and said second bottle have a generally cylindrical shape with a flat planar side with a generally longitudinal tongue and a generally longitudinal groove positioned in its planar side such that when the first bottle and the second bottle are placed with their respective planar sides against one another, the tongue of the first bottle mates with the groove of the second bottle and the tongue of the second bottle mates with the groove of the first bottle.

9. A spray bottle combination according to claim 1 wherein the means for controlling includes means for selectively varying relative amounts of first and second fluids entering the cylinder chamber.

10. A spray bottle combination according to claim 9 wherein the means for selectively varying relative amounts includes an externally actuable selector mechanism.

11. A spray bottle combination according to claim 10 wherein the externally actuable selector mechanism comprises a rotatable dial wheel.

12. A spray bottle combination according to claim 1 further comprising a rotatable external cap having an aperture therethrough, the aperture positioned off-center to be selectively positionable in line with the discharge nozzle or offset therefrom.

13. A spray bottle combination according to claim 1 wherein the cylinder chamber is positioned immediately adjacent the discharge nozzle for minimizing amount of fluid remaining downstream of the cylinder chamber after discharge of fluid.

14. A spray bottle combination according to claim 1 further comprising means for selectively shutting off fluid communication from one of said bottles to said cylinder chamber.

15. A spray bottle combination according to claim 1 wherein the means for controlling comprises a metering device placed in the first tubing means between the first bottle and the cylinder chamber.

16. A spray bottle combination according to claim 1 wherein said first bottle and said second bottle are constructed and arranged in a side-by-side relationship to one another.

17. A spray bottle combination according to claim 1 wherein said first bottle and said second bottle are constructed and arranged to be separable from each other.

18. A spray bottle combination comprising:

a sprayer mechanism including (a) a sprayer housing, (b) a discharge nozzle, (c) pumping mechanism disposed in the sprayer housing for drawing fluid into the pumping mechanism and discharging fluid to the discharge nozzle, and (d) actuation means for actuating the pumping mechanism, wherein actuation of the pumping mechanism forces fluid from the pumping mechanism out the discharge nozzle;

a first bottle containing a first fluid;
a second bottle containing a second fluid;
a first tubing means for providing fluid communication for the first fluid between the first bottle and the pumping mechanism;
a second tubing means for providing fluid communication for the second fluid between the second bottle and the pumping mechanism; and
means for controlling relative amounts of first and second fluids entering the pumping mechanism,
wherein the means for controlling comprises a metering device placed in the first tubing means between the first bottle and the pumping mechanism, the metering device comprising an axially translatable flow restriction device placed in the first tubing means between the first bottle and the pumping mechanism.

19. A spray bottle combination according to claim 18 wherein the first tubing and the second tubing join at a connector before entering the pumping mechanism.

20. A spray bottle combination according to claim 18 wherein the metering device provides for continuous adjustment of flow therethrough.

21. A spray bottle combination comprising:
a sprayer mechanism including (a) a sprayer housing, (b) a discharge nozzle, (c) pumping mechanism including a pump chamber disposed in the sprayer housing for drawing fluid into the pump chamber and discharging fluid therefrom, (d) a fluid passage between the pump chamber and the discharge nozzle, and (e) actuation means for actuating the pumping mechanism, wherein actuation of the pumping mechanism forces fluid from the pump chamber out the discharge nozzle;
a first bottle containing a first fluid;
a second bottle containing a second fluid; and
a first means for providing fluid communication for the first fluid between the first bottle and the pump chamber;
a second means for providing fluid communication for the second fluid between the second bottle and the pump chamber;
wherein the discharge nozzle comprises (a) a nozzle chamber, (b) a protruding orifice connected to said fluid passage from the pump chamber and extending into the nozzle chamber, and (c) a tip seal positioned in the nozzle chamber and having (i) a plurality of longitudinal ribs forming a fluid passage in the nozzle chamber external to the tip seal and (ii) a closed cavity means in a first end thereof for enclosing and sealing off the protruding orifice, the tip seal being axially translatable during actuation of the pumping mechanism, the tip seal moving to seal off the protruding orifice during drawing of fluid into the pump chamber and moving away form the protruding orifice during discharge of fluid therefrom.

22. A spray bottle combination according to claim 21 wherein the tip seal includes a swirl cavity means in its second end for directing fluid from the fluid passage in a circular motion.

23. A spray bottle combination comprising:
a sprayer mechanism including (a) a sprayer housing, (b) a discharge nozzle, (c) a cylinder chamber, (d) piston means disposed in the cylinder chamber axially moveable in a first direction for discharging fluid out the cylinder chamber to the discharge nozzle and in a second direction for drawing fluid into the cylinder chamber, and (e) actuation means for actuating the piston means, wherein actuation of the piston means forces fluid from the cylinder chamber out the discharge nozzle;
a first bottle containing a first fluid;
a second bottle containing a second fluid;
a first tubing means for providing fluid communication for the first fluid between the first bottle and the cylinder chamber;
a second tubing means for providing fluid communication for the second fluid between the second bottle and the cylinder chamber; and
means for controlling relative amounts of first and second fluids entering the cylinder chamber,
wherein the piston means comprises first and second internal passages for providing the fluid communication between the respective tubing means and the cylinder chamber.

24. A spray bottle combination comprising:
a first bottle containing a first fluid;
a second bottle containing a second fluid;
a trigger sprayer comprising a piston and cylinder, a nozzle, a trigger for actuating the piston, and a cylinder chamber within the cylinder wherein actuation of the piston forces fluid form the cylinder chamber out the nozzle;
a first tubing for providing a first fluid communication path for the first fluid between the first bottle and the cylinder chamber;
a second tubing for providing a second fluid communication path for the second fluid between the second bottle and the cylinder chamber, said second communication path being separate and independent from said first communication path; and
means for obtaining a desired ratio of first and second fluids entering the cylinder chamber.

25. A spray bottle combination according to claim 24 further comprising actuation means for selectively varying the desired ratio of first and second fluids entering the cylinder chamber.

26. A handheld fluid dispensing apparatus comprising:
a first container containing a first fluid;
a second container containing a second fluid;
a fluid dispensing head to which the first container and the second container are connectable, the fluid dispensing head comprising (a) a discharge nozzle, (b) a pump chamber, (c) pumping means for (i) drawing fluid form the first and second containers into the pump chamber at a desired fluid ratio and (ii) discharging fluid out the pump chamber to the discharge nozzle, and (d) actuation means for actuating the pumping means, wherein actuation of the pumping means forces fluid from the pump chamber out through the discharge nozzle;
a first fluid passage providing fluid communication for the first fluid between the first container and the pump chamber; and
a second fluid passage providing fluid communication for the second fluid between the second container and the pump chamber, said second fluid passage being independent from said first fluid passage.

27. A fluid dispensing apparatus according to claim 26 further comprising ratio selection means for selectively varying the desired ratio of first and second fluids entering the pump chamber.

28. A fluid dispensing apparatus according to claim 26 further comprising a third container containing a third fluid and a third fluid passage means for providing fluid communication for the third fluid between the third container and the pump chamber.

* * * * *